US011656056B2

(12) United States Patent
McPherson

(10) Patent No.: US 11,656,056 B2
(45) Date of Patent: May 23, 2023

(54) ARCHERY BOW LIMB REINFORCEMENT

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/513,740

(22) Filed: Oct. 28, 2021

(65) Prior Publication Data

US 2022/0136794 A1 May 5, 2022

Related U.S. Application Data

(60) Provisional application No. 63/107,351, filed on Oct. 29, 2020.

(51) Int. Cl.
*F41B 5/10* (2006.01)
*F41B 5/14* (2006.01)

(52) U.S. Cl.
CPC ..... *F41B 5/10* (2013.01); *F41B 5/1403* (2013.01)

(58) Field of Classification Search
CPC ..... F41B 5/10
See application file for complete search history.

(56) References Cited

U.S. PATENT DOCUMENTS

| | | | | |
|---|---|---|---|---|
| 4,671,249 | A * | 6/1987 | Troncoso | F41B 5/0057 124/23.1 |
| 5,377,658 | A * | 1/1995 | Shepley, Jr. | F41B 5/10 124/88 |
| 5,718,212 | A * | 2/1998 | Allshouse | F41B 5/0063 124/23.1 |
| 6,684,870 | B1 * | 2/2004 | Land | F41B 5/1426 124/23.1 |
| 6,886,549 | B2 | 5/2005 | McPherson | |
| 7,077,116 | B1 | 7/2006 | Darlington | |
| 7,311,096 | B2 * | 12/2007 | Gallops, Jr. | F41B 5/10 124/23.1 |
| 8,047,189 | B2 | 11/2011 | McPherson | |
| 8,453,635 | B1 | 6/2013 | McPherson | |
| 8,776,770 | B2 | 7/2014 | Batdorf | |
| 8,839,775 | B2 | 9/2014 | Wasilewski et al. | |
| 9,389,039 | B2 | 7/2016 | Denton et al. | |
| 2017/0122694 | A1 * | 5/2017 | Achkar | F41B 5/10 |
| 2021/0140736 | A1 | 5/2021 | Romero | |

* cited by examiner

*Primary Examiner* — John A Ricci
(74) *Attorney, Agent, or Firm* — Laabs Intellectual Property

(57) ABSTRACT

In some embodiments, an archery bow limb comprises a body comprising a first end and a second end. The first end is arranged to be supported by a riser. The second end is arranged to support an axle and a rotatable member. A reinforcing member extends through the body. The reinforcing member is oriented parallel to the axle.

20 Claims, 3 Drawing Sheets

ARCHERY BOW LIMB REINFORCEMENT

CROSS-REFERENCE TO RELATED APPLICATIONS

This application claims the benefit of U.S. Patent Application No. 63/107,351, filed Oct. 29, 2020, the entire content of which is hereby incorporated herein by reference.

BACKGROUND OF THE INVENTION

This invention relates generally to archery bows and more specifically to archery bow limbs.

Archery bows are generally known in the art. Drawing the bowstring of an archery bow stores energy in the bow. This energy is often stored by flexing limbs of the bow. The stored energy is desirably used to propel an arrow.

It is generally desirable for an archery bow to have a low weight. There is a trade-off between strength and longevity. For example, a heavier, stronger bow tends to have a longer lifespan than a bow that is comparatively lighter and more fragile.

There remains a need for novel structures that provide benefits over prior structures. There remains a need for archery bow limb arrangements that are lightweight and have a long service life.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow limb comprises a body comprising a first end and a second end. The first end is arranged to be supported by a riser. The second end is arranged to support an axle and a rotatable member. A reinforcing member extends through the body. The reinforcing member is oriented parallel to the axle.

In some embodiments, the reinforcing member applies a compressive force to the body.

In some embodiments, the archery bow limb comprises a first bracket arranged to abut a first side of the body and the first bracket is engaged with the reinforcing member. In some embodiments, the first bracket is threadably engaged with the reinforcing member. In some embodiments, the first bracket comprises a surface arranged to contact the body, wherein the surface is oriented non-parallel to a longitudinal axis of the body.

In some embodiments, the archery bow limb comprises a second bracket arranged to abut a second side of the body and the second bracket is engaged with the reinforcing member.

In some embodiments, the first bracket comprises a first surface and the second bracket comprises a second surface. The first surface and the second surface are oriented at equal-but-opposite angles to a longitudinal axis of the body.

In some embodiments, the body comprises a midportion located between the first end and the second end, and the reinforcing member extends through the midportion.

In some embodiments, the archery bow limb comprises a secondary reinforcing mechanism, the secondary reinforcing mechanism contacting a tension surface and a compression surface of the body.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
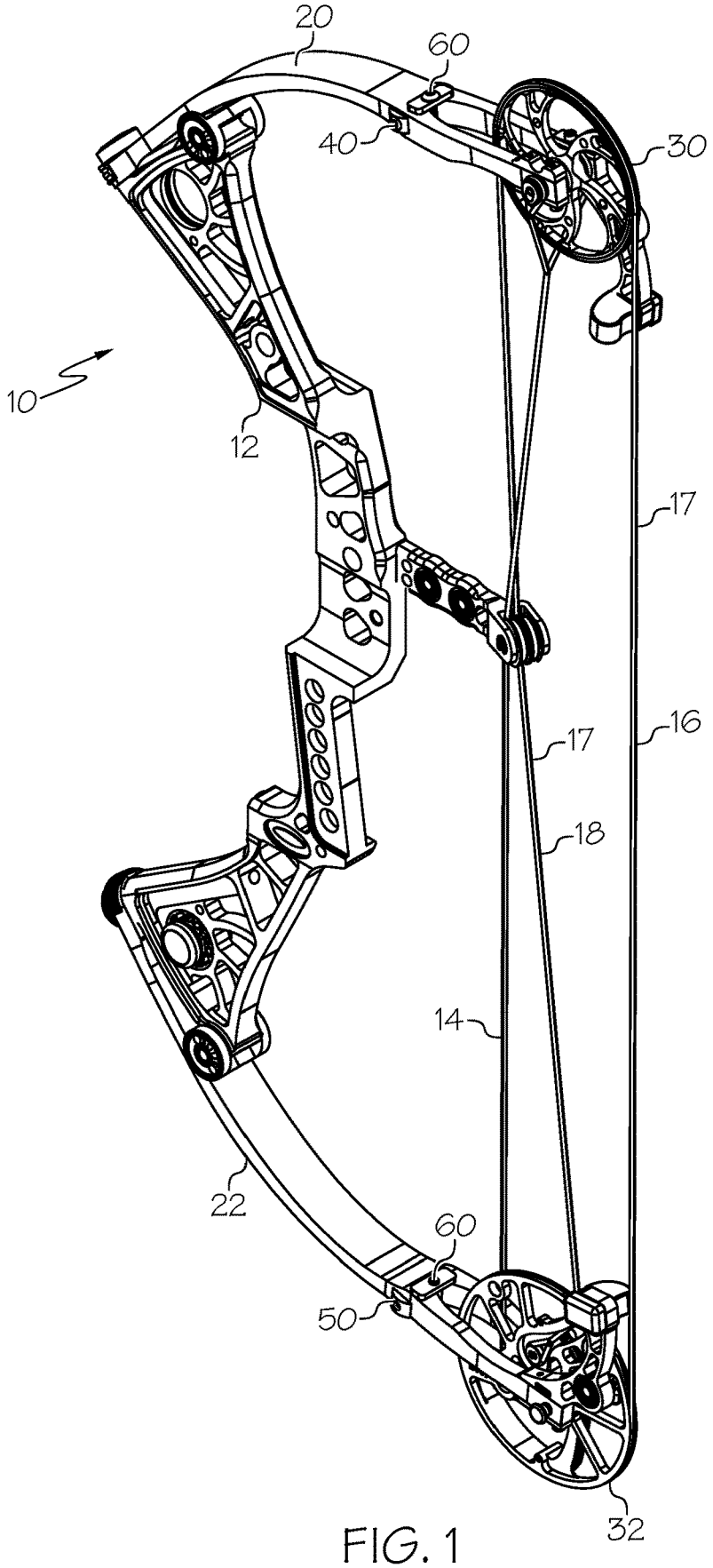
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, an archery bow 10 comprises a riser 12, a first limb 20, a second limb 22 and a bowstring 16. In some embodiments, an archery bow 10 comprises a compound bow, for example comprising a first rotatable member 30, a second rotatable member 32 and a power cable 14. In some embodiments, a rotatable member 32 comprises a cam and the power cable 14 is arranged to be taken up by the cam as the bowstring 16 is drawn. In some embodiments, a bow 10 can comprise a two-cam bow, for example having two cams and two power cables. In some embodiments, a bow 10 can comprise a single-cam bow, for example as shown in FIG. 1. In some embodiments, a single-cam bow 10 comprises a continuous cable segment 17 that comprises both the bowstring 16 and a control cable segment 18.

In some embodiments, an archery bow 10 comprises a reinforcing member 40. In some embodiments, a limb 20 comprises a reinforcing member 40. In some embodiments, a first limb 20 comprises a first reinforcing member 40 and a second limb 22 comprises a second reinforcing member 50. In some embodiments, the second reinforcing member 50 is similar to the first reinforcing member 40, for example comprising components of similar size and shape.

Figure 2:
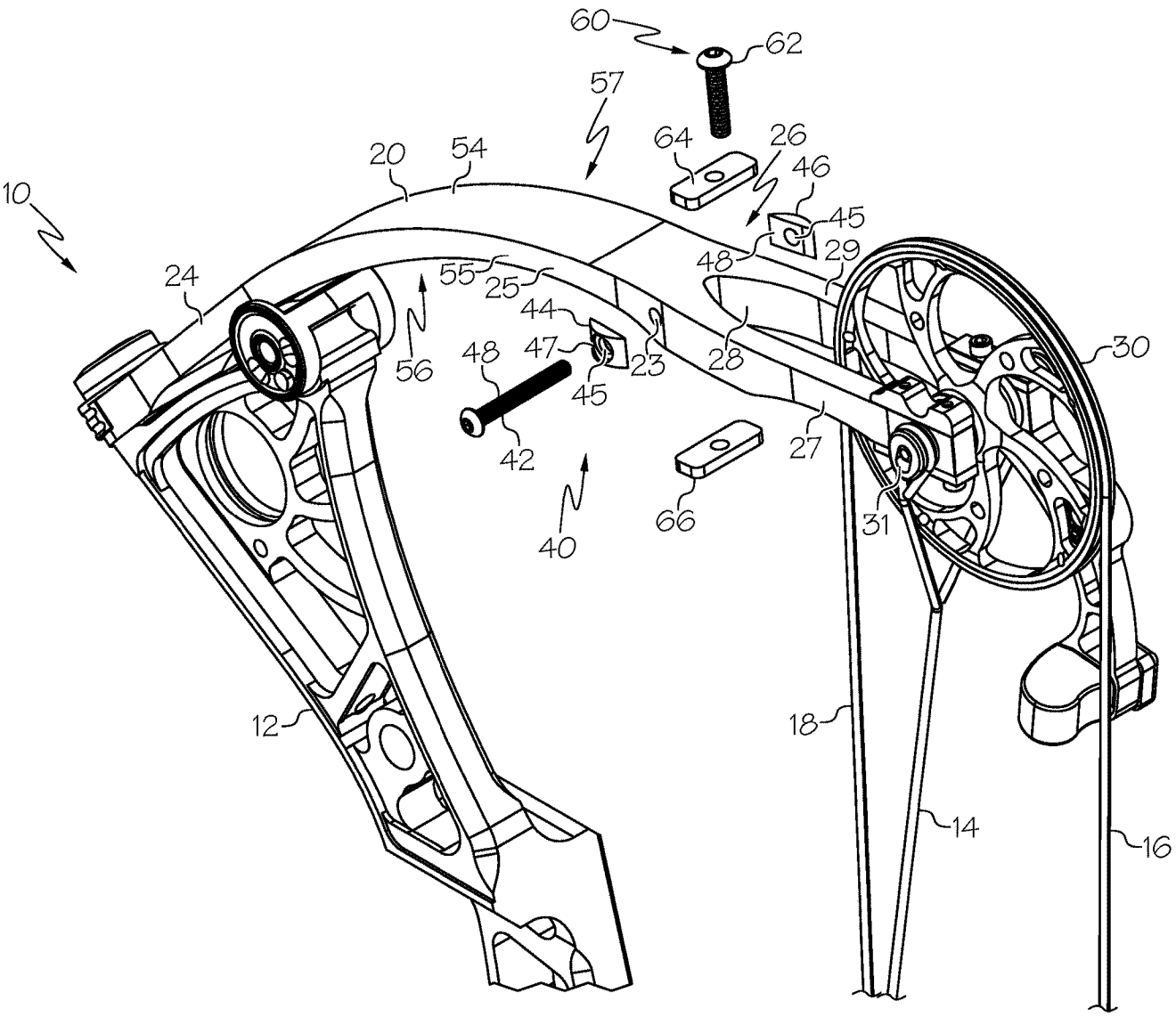
FIG. 2 shows an exploded view of a reinforcing member and a portion of an embodiment of an archery bow.

FIG. 2 shows an embodiment of an archery bow 10 and an exploded view of an embodiment of a reinforcing member 40.

In some embodiments, a limb 20 comprises a tension surface 54, compression surface 56, a first side 55 and a second side 57. In some embodiments, a limb 20 comprises a first end portion 24, a midportion 25 and a second end portion 26 along its length. In some embodiments, the first end portion 24 is engaged with the riser 12. In some embodiments, the second end portion 26 supports an axle 31. In some embodiments, an axle 31 supports a rotatable member 30. In some embodiments, the second end portion 26 comprises a fork 28 comprising a first arm 27 and a second arm 29. In some embodiments, the fork 28 defines a cavity located between the first arm 27 and the second arm 29. In some embodiments, the axle 31 extends between the first arm 27 and the second arm 29. In some embodiments, a rotatable member 30 is positioned between the first arm 27 and the second arm 29.

In some embodiments, a reinforcing member 40 extends through the limb 20. In some embodiments, a limb 20 comprises an aperture 23 and a reinforcing member 40 is oriented in the aperture 23. In some embodiments, a reinforcing member 40 comprises a shaft 42. In some embodiments, the shaft 42 extends through the limb 20. In some embodiments, the shaft 42 is oriented in the aperture 23. In some embodiments, the shaft 42 comprises a shear pin that reinforces the limb 20 against shear forces. In some embodiments, the shaft 42 is oriented parallel to the axle 31.

In some embodiments, a reinforcing member 40 comprises a bracket 44. In some embodiments, the shaft 42 is engaged with the bracket 44. Any suitable engagement mechanism can be used. In some embodiments, a bracket 44 comprises a clip, for example an e-clip as commonly used on archery bows to engage an axle. In some embodiments, a bracket 44 comprises an aperture 45. In some embodiments, the shaft 42 extends through the aperture 45. In some embodiments, the shaft 42 comprises a head 43 or other protrusion, and the head 43 abuts the bracket 44. In some embodiments, a size of the head 43 is greater than a size of the aperture 23. In some embodiments, the bracket 44 comprises a flange 47 arranged to abut the head 43.

In some embodiments, a bracket 44 comprises a first bracket 44 and the reinforcing member further comprises a second bracket 46. In some embodiments, the shaft 42 is engaged with the second bracket 46. Any suitable engagement mechanism can be used. In some embodiments, the second bracket 46 comprises an aperture 45 and the shaft 42 extends through the aperture 45. In some embodiments, the second bracket 46 comprises screw threads 48. In some embodiments, the shaft 42 comprises threads 48 arranged to engage the second bracket 46.

In some embodiments, the reinforcing member 40 is arranged to apply a compressive force to the limb 20. In some embodiments, the first bracket 44 is arranged to contact the first side 55 of the limb 20 and the second bracket 46 is arranged to contact the second side 57 of the limb. In some embodiments, the reinforcing member applies a compressive force to the first side 55 and second side 57 of the limb 20.

In some embodiments, the reinforcing member 40 is located in the midportion 25 of the limb 20. In some embodiments, the reinforcing member 40 extends through the midportion 25 of the limb 20. In some embodiments, an aperture 23 is located in the midportion 25 of the limb 20. In some embodiments, the shaft 42 is located in the midportion 25 of the limb 20.

In some embodiments, a limb 20 comprises a secondary reinforcing mechanism 60. In some embodiments, a secondary reinforcing mechanism 60 comprises a clamp arranged to compress the limb 20. In some embodiments, a secondary reinforcing mechanism 60 comprises a first pad 64, a second pad 66 and a connector 62. In some embodiments, the connector 62 engages the first pad 64 and the second pad 66, and the pads 64, 66 apply a compressive force to the limb 20. In some embodiments, the first pad 64 contacts the tension surface 54 of the limb 20. In some embodiments, the second pad 66 contacts the compression surface 56 of the limb 20. In some embodiments, the secondary reinforcing mechanism 60 applies a compressive force to the limb 20.

In some embodiments, the secondary reinforcing mechanism 60 is located outside of the midportion 25 of the limb 20. In some embodiments, the secondary reinforcing mechanism 60 is located in the second end portion 26 of the limb 20. In some embodiments, a secondary reinforcing mechanism 60 comprises a first pad 64 arranged to contact the first arm 27 and the second arm 29 of the second end portion 26 of a limb 20. In some embodiments, a second pad 66 is arranged to contact the first arm 27 and the second arm 29. In some embodiments, a fork 28 in the limb 20 defines a cavity, and the connector 62 is oriented in the cavity.

In some embodiments, the connector 62 comprises a shaft oriented orthogonal to a reinforcing member 40. In some embodiments, the connector 62 comprises a shaft oriented orthogonal to an axle 31 supported by the limb 20.

Figure 3:
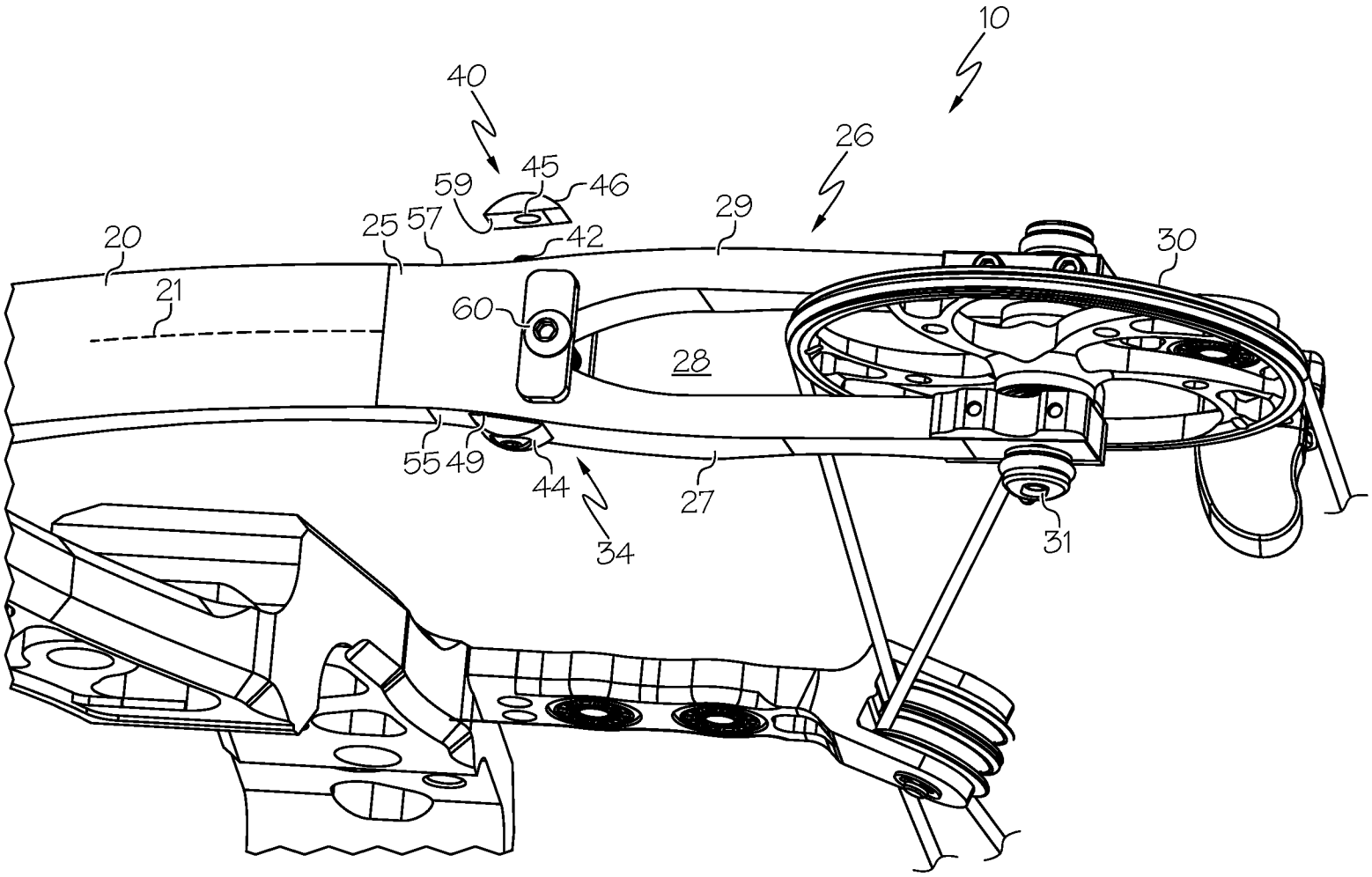
FIG. 3 shows another view of an embodiment of an archery bow.

FIG. 3 shows an embodiment of an archery bow 10. In some embodiments, a limb 20 comprises a tapered portion 34. In some embodiments, the midportion 25 of the limb 20 comprises a tapered portion 34. In some embodiments, the tapered portion 34 comprises a first side 55 and a second side 57 that are non-parallel.

In some embodiments, a reinforcing member 40 is oriented in a tapered portion 34 of the limb 20. In some embodiments, the first bracket 44 comprises a first surface 49 oriented nonparallel to a longitudinal axis 21 of the limb 20. In some embodiments, the second bracket 46 comprises a second surface 59 oriented nonparallel to a longitudinal axis 21 of the limb 20. In some embodiments, the first surface 49 and the second surface 59 are oriented at equal-but-opposite angles to the longitudinal axis 21 of the limb 20.

In some embodiments, a bracket 44, 46 comprises an aperture 45. In some embodiments, a central axis of the aperture 45 is oriented at a non-orthogonal angle to the surface 49, 59 of the bracket 44, 46 arranged to contact the limb 20.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow limb comprising:

a body comprising a first end, a forked portion and a second end, the first end arranged to be supported by a riser, the second end supporting an axle and a rotatable member, the forked portion defining a cavity; and a reinforcing member extending through the body, the reinforcing member oriented parallel to the axle, the reinforcing member located adjacent to the cavity.

2. The archery bow limb of claim 1, the reinforcing member applying a compressive force to the body.

3. The archery bow limb of claim 1, the reinforcing member comprising a pin.

4. The archery bow limb of claim 1, comprising a first bracket arranged to abut a first side of the body, the first bracket engaged with the reinforcing member.

5. The archery bow limb of claim 4, the first bracket threadably engaged with the reinforcing member.

6. The archery bow limb of claim 4, comprising a second bracket arranged to abut a second side of the body, the second bracket engaged with the reinforcing member.

7. The archery bow limb of claim 6, the first bracket and second bracket applying a compressive force to the body.

8. The archery bow limb of claim 6, the first bracket comprising a first surface and the second bracket comprising a second surface, the first surface and the second surface oriented at equal-but-opposite angles to a longitudinal axis of the body.

9. The archery bow limb of claim 1, the body comprising a midportion located between the first end and the second end, the reinforcing member extending through the midportion.

10. The archery bow limb of claim 1, comprising a secondary reinforcing mechanism, the secondary reinforcing mechanism contacting a tension surface and a compression surface of the body.

11. The archery bow limb of claim 10, the secondary reinforcing mechanism comprising a connector, the connector oriented orthogonal to the reinforcing member.

12. The archery bow limb of claim 11, the forked portion comprising a first arm and a second arm separated by the cavity, the connector oriented in the cavity.

13. The archery bow limb of claim 12, the secondary reinforcing mechanism comprising a pad arranged to contact the top of the body, the pad contacting the first arm and the second arm.

14. An archery bow limb comprising:

a body comprising a first end and a second end, the first end arranged to be supported by a riser, the second end supporting an axle and a rotatable member; and a reinforcing member extending through the body, the reinforcing member oriented parallel to the axle;

a first bracket arranged to abut a first side of the body, the first bracket engaged with the reinforcing member;

the first bracket comprising a surface arranged to contact the body, the surface oriented non-parallel to a longitudinal axis of the body.

15. The archery bow limb of claim 14, the first bracket comprising an aperture comprising a central axis, the surface oriented at a non-orthogonal angle to the central axis.

16. The archery bow limb of claim 14, comprising a second bracket arranged to abut a second side of the body, the second bracket engaged with the reinforcing member.

17. The archery bow limb of claim 16, the surface comprising a first surface, the second bracket comprising a second surface, the first surface and the second surface oriented at equal-but-opposite angles to the longitudinal axis of the body.

18. The archery bow limb of claim 14, comprising a secondary reinforcing mechanism, the secondary reinforcing mechanism contacting a tension surface and a compression surface of the body.

19. The archery bow limb of claim 14, the first bracket threadably engaged with the reinforcing member.

20. An archery bow limb comprising:

a body comprising a first end and a second end, the first end arranged to be supported by a riser, the second end supporting an axle and a rotatable member; and a reinforcing member extending through the body, the reinforcing member oriented parallel to the axle;

the body comprising a midportion located between the first end and the second end, the reinforcing member extending through the midportion;

the midportion comprising a tapered portion, the reinforcing member extending through the tapered portion.

* * * * *